US006792716B1

(12) United States Patent
Luster

(10) Patent No.: US 6,792,716 B1
(45) Date of Patent: Sep. 21, 2004

(54) BARRIER GATE

(76) Inventor: Aubrey Dennis Luster, 1200 Martin Luther King Blvd., Killeen, TX (US) 76543

( * ) Notice: Subject to any disclaimer, the term of this patent is extended or adjusted under 35 U.S.C. 154(b) by 41 days.

(21) Appl. No.: 10/361,510

(22) Filed: Feb. 11, 2003

Related U.S. Application Data

(60) Provisional application No. 60/356,017, filed on Feb. 12, 2002.

(51) Int. Cl.[7] ..... E01F 13/00
(52) U.S. Cl. ..... 49/49; 49/387
(58) Field of Search ..... 49/49, 226, 227, 49/232, 386, 387; 16/357, 360, 362, 364

(56) References Cited

U.S. PATENT DOCUMENTS

| | | | | | |
|---|---|---|---|---|---|
| 1,662,318 A | * | 3/1928 | McCorkel | 49/297 |
| 1,851,968 A | * | 3/1932 | Classen | 49/387 |
| 2,032,221 A | * | 2/1936 | Myers | 220/814 |
| 2,543,230 A | | 2/1951 | Dart | 126/298 |
| 2,563,894 A | * | 8/1951 | White | 49/226 |
| 4,122,629 A | | 10/1978 | Rennick | 49/357 |
| 4,356,668 A | | 11/1982 | Wagner | 49/506 |
| 4,989,835 A | | 2/1991 | Hirsh | 256/13.1 |
| 5,054,723 A | | 10/1991 | Arnold | 248/65 |
| 5,299,386 A | | 4/1994 | Naegelli | 49/28 |
| 5,459,963 A | | 10/1995 | Alexander | 49/34 |
| 5,564,238 A | | 10/1996 | Ellis | 52/173.2 |

* cited by examiner

*Primary Examiner*—Jerry Redman
(74) *Attorney, Agent, or Firm*—Welsh & Flaxman LLC

(57) ABSTRACT

A barrier gate includes a crossbar selectively pivoting between a saddle post and anchor post. The crossbar includes a first end and a second end. The first end of the cross bar is pivotally secured to the anchor post such that the second end of the crossbar may be selectively lifted from the saddle post opening the barrier gate and providing access therethrough. The barrier gate also includes a locking mechanism at the first end of the crossbar for permitting the selective locking of the crossbar in a substantially vertically orientation. The barrier gate further includes a counterweight interacting with the crossbar for assisting in the lifting of the crossbar between a closed orientation and an open orientation, and a cable linking the counterweight to the crossbar.

14 Claims, 5 Drawing Sheets

BARRIER GATE

CROSS REFERENCE TO RELATED APPLICATION

This application is a non-provisional of U.S. Provisional Application Ser. No. 60/356,017, filed Feb. 12, 2002, entitled "BarriGate", which is currently pending.

BACKGROUND OF THE INVENTION

1. Field of the Invention

The invention relates to a barrier gate. More particularly, the invention relates to a counterweighted barrier gate positioned adjacent a receiving dock overhead door for preventing inadvertent damage thereto.

2. Description of the Prior Art

The prior art discloses a variety gates developed for controlling the movement of machinery within loading areas. However, these prior art systems are cumbersome to use, highly expensive to install and generally do not meet the needs of the their operators.

As such, a need exists for a barrier gate which is easy to install, use and maintain, while simultaneous offering operators cost effective alternative to damage resulting from loading dock accidents. The present invention provides such a barrier gate.

SUMMARY OF THE INVENTION

It is, therefore, an object of the present invention to provide a barrier gate. The barrier gate includes a crossbar selectively pivoting between a saddle post and anchor post. The crossbar includes a first end and a second end. The first end of the crossbar is pivotally secured to the anchor post such that the second end of the crossbar maybe selectively lifted from the saddle post opening the barrier gate and providing access therethrough. The barrier gate also includes a locking mechanism at the first end of the crossbar for permitting the selective locking of the crossbar in a substantially vertically orientation. The barrier gate further includes a counterweight interacting with the crossbar for assisting in the lifting of the crossbar between a closed orientation and an open orientation, and a cable linking the counterweight to the crossbar.

It is also an object of the present invention to provide a barrier gate wherein the anchor post is substantially hollow and the counterweight is housed therein.

It is another object of the present invention to provide a barrier gate wherein a pulley guides the cable between the crossbar and the counterweight.

It is a further object of the present invention to provide a barrier gate wherein the anchor post includes an upwardly extending post in which the counterweight is housed and the pulley is secured at the upper end of the upwardly extending post.

It is yet another object of the present invention to provide a barrier gate wherein the locking mechanism includes a slot formed along the first end of the crossbar such that the crossbar may be moved relative to the anchor post for locking the crossbar in a substantially vertical orientation.

It is also another object of the present invention to provide a barrier gate wherein the slot extends along the longitudinal axis of the crossbar.

It is still a further object of the present invention to provide a barrier gate wherein the crossbar is telescopically received within the anchor post when in its vertical orientation.

It is also an object of the present invention to provide a barrier gate wherein the anchor post includes a hollow crossbar receiving member. The crossbar receiving member includes a cut-out recess in which the first end of the crossbar sits and the crossbar is telescopically received within the crossbar receiving member when in its vertical orientation.

It is another object of the present invention to provide a barrier gate wherein the cut-out recess includes upwardly extending walls preventing lateral movement of the crossbar.

It is a further object of the present invention to provide a barrier gate wherein when the crossbar is rotated upwardly to its vertical orientation, the first end of the crossbar slides downwardly into the crossbar receiving member and movement of the crossbar is limited by the length of the slot and its interaction with a pivot pin passing through the slot and pivotally coupling the first end of the crossbar to the anchor post.

It is also an object of the present invention to provide a barrier gate wherein the crossbar is provided with handles.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
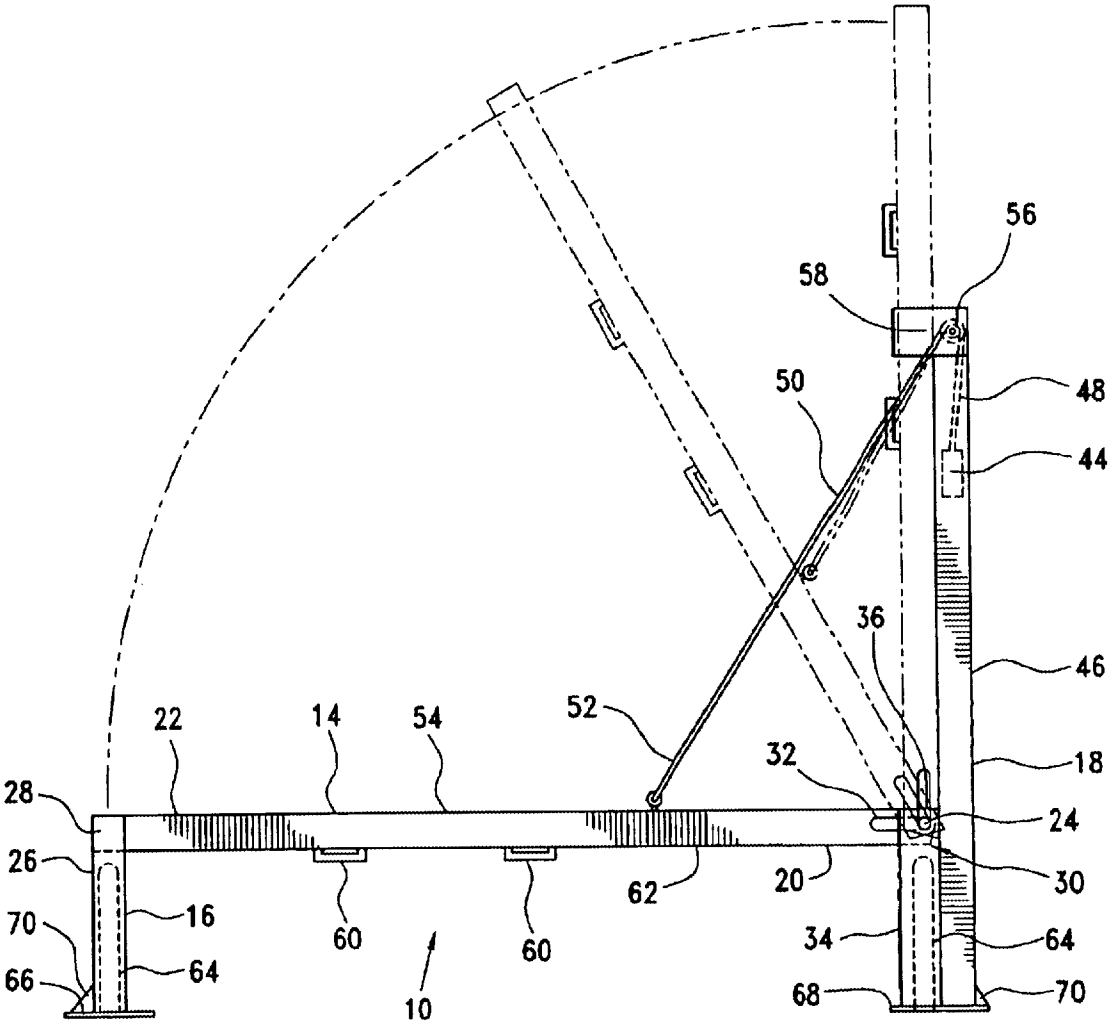
FIG. 1 is a schematic of the present barrier gate showing the barrier gate moving from an open orientation to a closed orientation.
Figure 2:
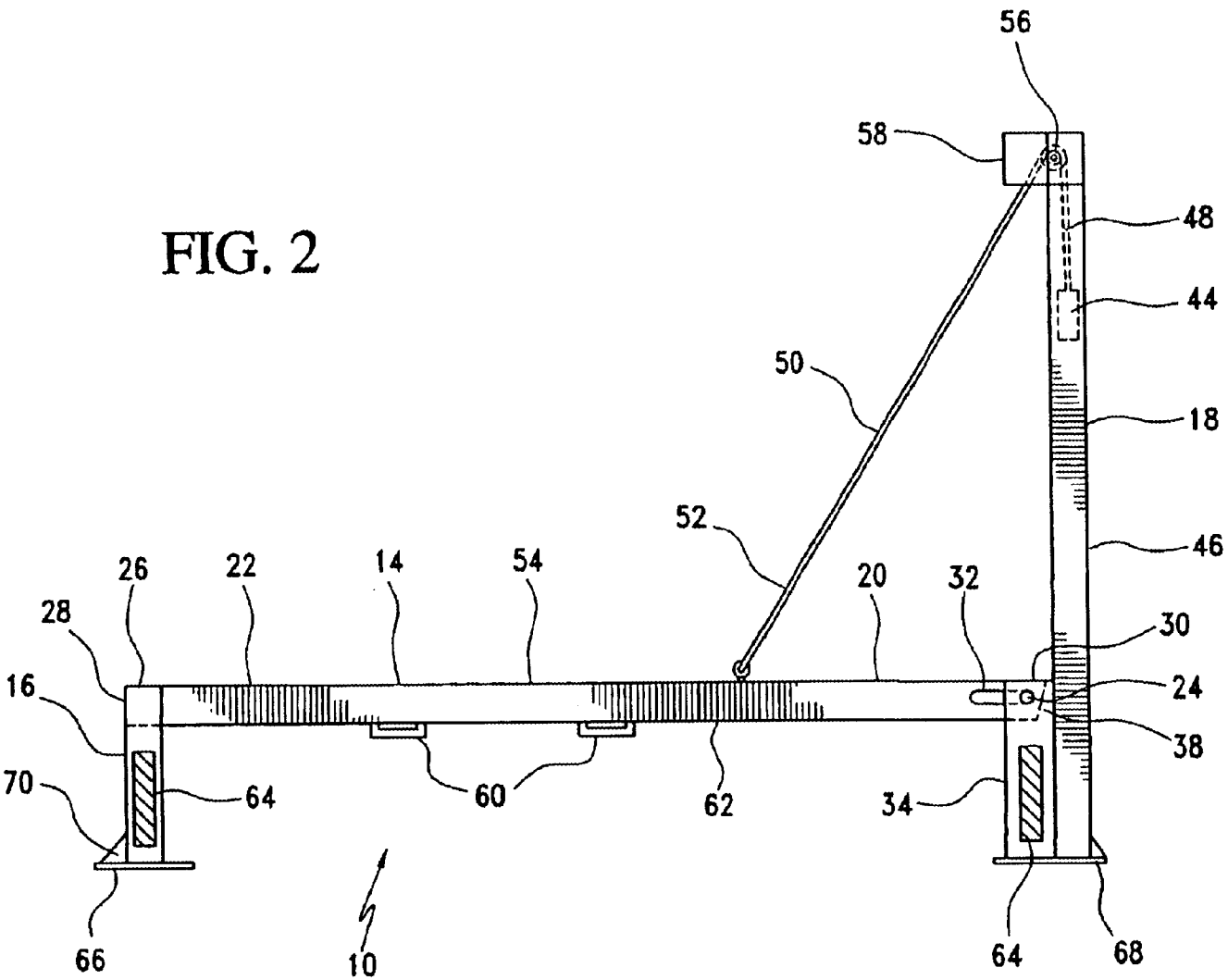
FIG. 2 is a side view of the present barrier gate with the crossbar in its horizontal position.
Figure 3:
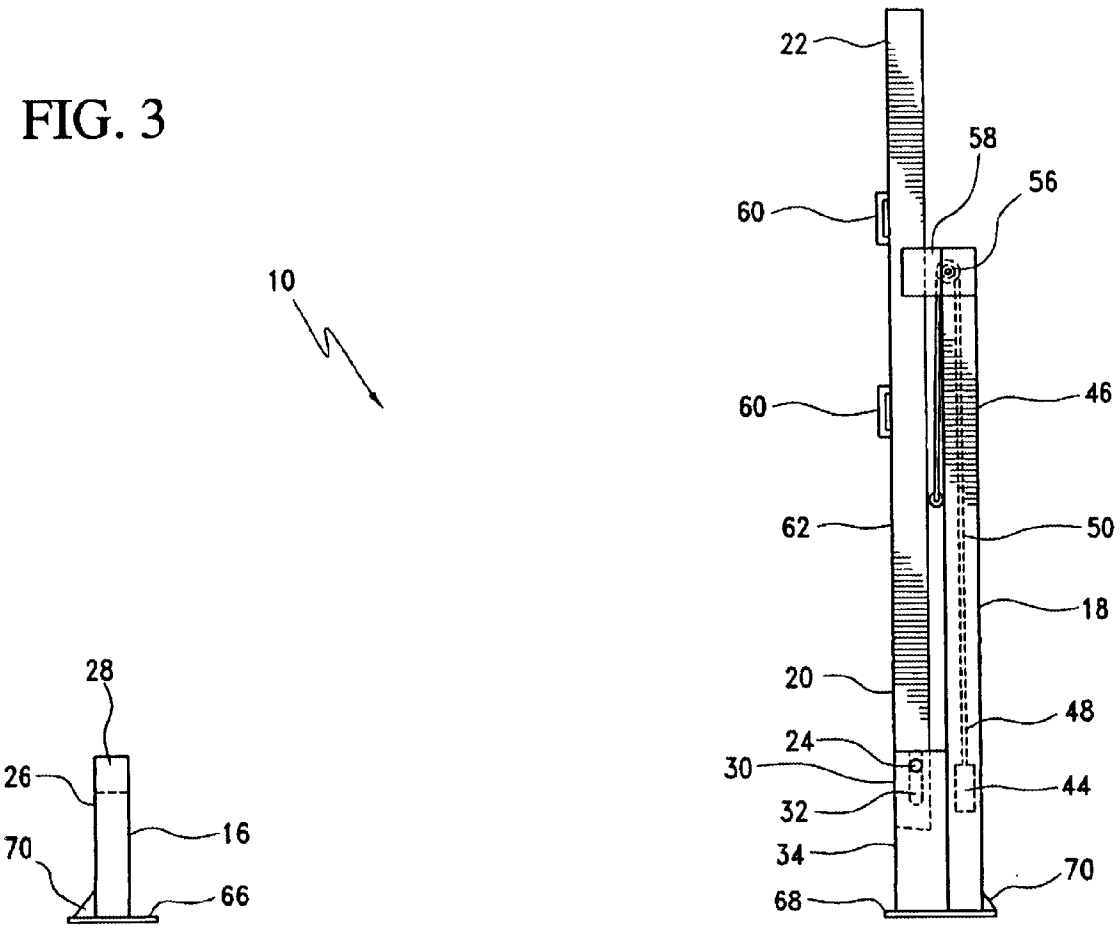
FIG. 3 is a side view of the present barrier gate with the crossbar in its vertical position.
Figure 5:
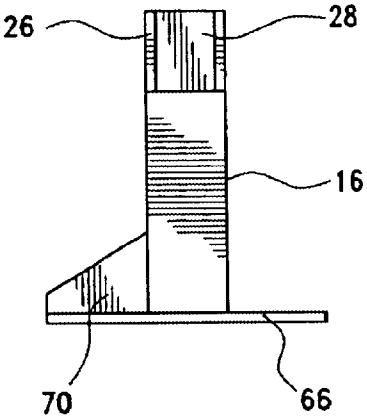
FIG. 5 is a frontal view of the saddle post.
Figure 4:
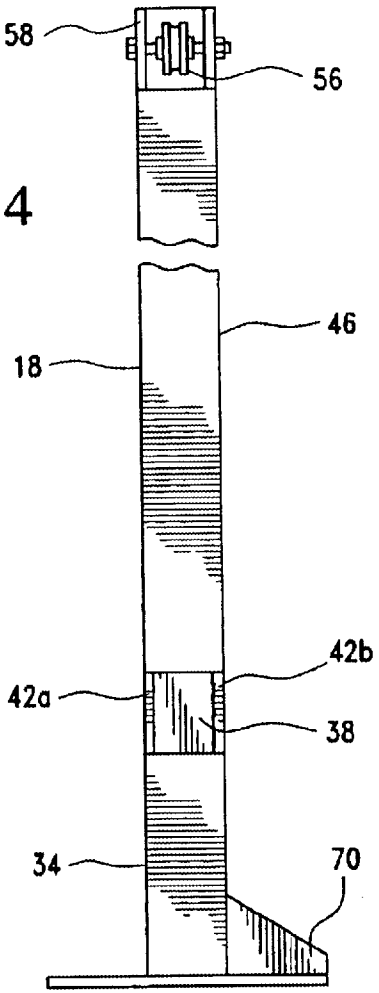
FIG. 4 is a frontal view of the anchor post.
Figure 8:
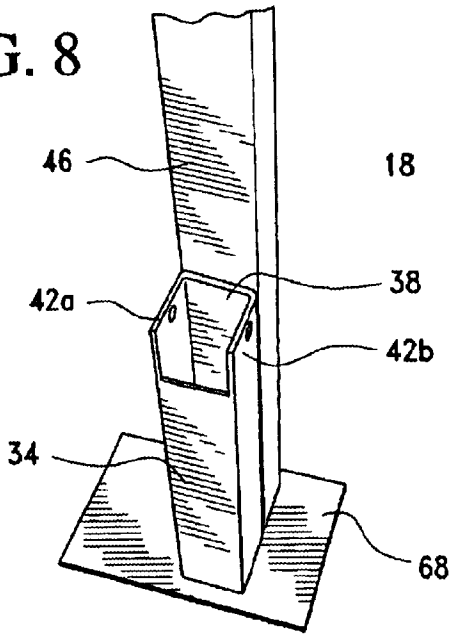
FIG. 8 is a perspective view of the anchor post.
Figure 6:
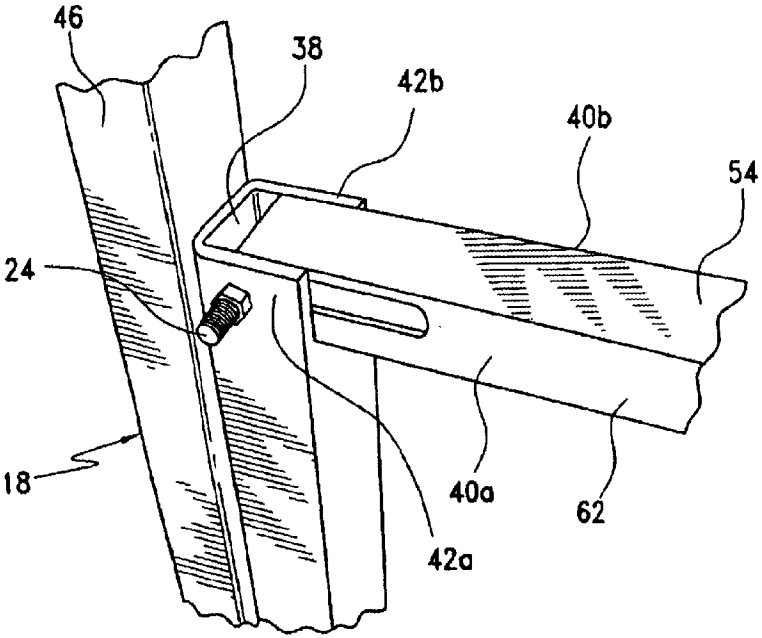
FIG. 6 is a detailed perspective view of the pivotal attachment between the crossbar and anchor post.
Figure 7:
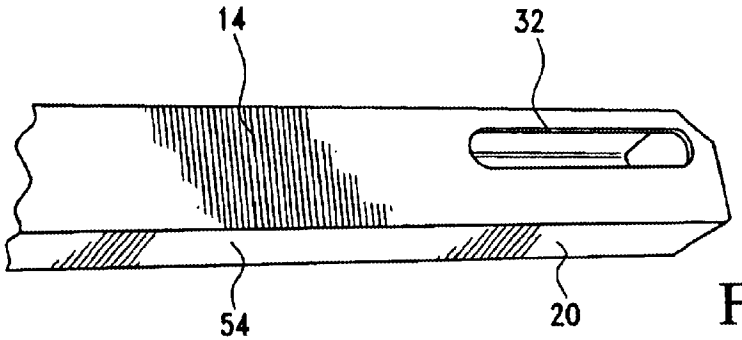
FIG. 7 is a detailed perspective view of the first end of the crossbar.

With reference to FIGS. 1 to 8, a barrier gate 10 is disclosed. The barrier gate 10 is adapted for positioning adjacent a receiving dock overhead door 12 for preventing inadvertent contact therewith and minimizing damage that might occur when forklifts, pallet jacks and other loading dock equipment inadvertently come in contact therewith. Although the barrier gate 10 is particularly designed with the protection of overhead doors 12 in mind, the barrier gate 10 may be used in blocking corridors and gaps in platform railings where intermittent access is desired, or in selectively blocking other areas, without departing from the spirit of the present invention.

The barrier gate 10 generally includes a crossbar 14 that pivots between a saddle post 16 and anchor post 18. The crossbar 14 includes a first end 20 and a second end 22. The first end 20 is pivotally secured to the anchor post 18 such that the second end 22 of the crossbar 14 may be selectively lifted from the saddle post 16 opening the barrier gate 10 and providing access to the opposite side thereof.

A pivot pin 24 secures the first end 20 of the crossbar 14 to the anchor post 18. In accordance with a preferred embodiment of the present invention, the pivot pin 24 is positioned at height placing the crossbar 14 approximately 23.75 inches above the ground when the crossbar 14 is in its horizontal closed position. The crossbar 14 is shaped and dimensioned to span the length of a conventional loading dock door 12 and is approximately 8.75 feet in length in accordance with a preferred embodiment of the present invention. While specific lengths are provided in describing a preferred embodiment of the present invention, those skilled in the art will appreciate that the dimensions of the present barrier gate may be readily adjusted to suit specific applications without departing from the spirit of the present invention.

Pivotal movement of the crossbar 14 relative to the anchor post 18 is controlled through a variety of structural modifications. First the closed position of the crossbar 14 is controlled by the provision of a saddle post 16 for supporting the second end 22 of the crossbar 14 when the crossbar 14 is horizontal positioned, preventing access therethrough. With this in mind, the upper end 26 of the saddle post is provided with an upwardly extending crossbar recess 28. The recess 28 is shaped and dimensioned for receiving and supporting the second end 22 of the crossbar 14 when the crossbar 14 is horizontally positioned in its closed position.

The crossbar 14 may also be selectively locked in an open position. A locking mechanism 30 is provided at the first end 20 of the crossbar 14 for permitting the selective locking of the crossbar 14 in a substantially vertically orientation. The locking mechanism 30 includes an elongated slot 32 formed in the crossbar 14 and extending along the longitudinal axis of the crossbar 14. More particularly, the anchor post 18 includes a crossbar receiving member 34 shaped and dimensioned for telescopically receiving first end 20 of the crossbar 14.

The crossbar receiving member 34 is a hollow tubular member and includes a first end 36 with a cut-out recess 38 oriented for receiving the first end 20 of the crossbar 14 as it sits in its horizontal orientation. As such, the first end 20 of the crossbar 14 sits within the cut-out recess 38 with the lateral sides 40*a*, 40*b* of the crossbar 14 facing the upwardly extending walls 42*a*, 42*b* of the crossbar receiving member 34. The provision of the upwardly extending walls 42*a*, 42*b* prevent lateral movement of the crossbar 14 and also provides a support structure through which the pivot pin 24 may pass as it passes through the slot 32 of crossbar 14 in a manner pivotally securing the crossbar 14 to the crossbar receiving member 34.

The provision of the slot 32 and a hollow crossbar receiving member 34 allows for limited telescopic movement of the first end 20 of the crossbar 14 within the crossbar receiving member 34 when the crossbar 14 is vertically oriented. That is, when the crossbar 14 is rotated upwardly to its vertical orientation, the first end 20 of the crossbar 14 slides downwardly into the crossbar receiving member 34. The downward movement of the crossbar 14 is limited by the length of the slot 32 and its interaction with the pivot pin 24. With this in mind, the slot 32 is of a length sufficient to allow the crossbar 14 to slide within the crossbar receiving member 34 a sufficient distance to selectively lock it in a vertical orientation, but not so far that it is difficult to remove the first end 20 of the crossbar 14 from the crossbar receiving member 34 and rotate the crossbar 14 down to its closed position.

In practice, the crossbar 14 is lifted to its vertical, open position. Once the crossbar 14 is substantially vertical it is telescopically received within the crossbar receiving member 34 and slides downwardly within the crossbar receiving member 34 a distance limited by the interaction between the slot 32 and the pivot pin 24. The crossbar 14 is now "locked" in its open position. When one desires to close the barrier gate 10, the crossbar 14 is lifted upwardly within the crossbar receiving member 34 to remove the first end 20 of the crossbar 14 from within the crossbar receiving member 34. Once the first end 20 of the crossbar 14 is removed from the crossbar receiving member 34, the crossbar 14 is free to rotate downwardly to its closed position. The crossbar 14 will rotate downwardly under the control of the operator until the second end 22 of the crossbar 14 is received within the saddle post 16.

As one can certainly appreciate, the weight of the extending crossbar 14 might make it difficult to rotate the crossbar 14 upwardly when one desires access through the gate 10. A counterweight 44 is, therefore, provided. The counterweight 44 is hidden within the upwardly extending post 46 of the anchor post 18 and is linked to the crossbar 14 via a cable/pulley system. Although the crossbar receiving post 34 and the upwardly extending post 46 are linked to form a unitary structure in accordance with a preferred embodiment of the present invention, it is contemplated that these components may be separated without departing from the spirit of the present invention.

A first end 48 of the cable 50 is connected to the counterweight 44 and the second end 52 of the cable is connected to the upper surface 54 of the crossbar 14. The second end 52 of the cable 50 is connected to the crossbar 14 at a central position along the length of the crossbar 14. In accordance with a preferred embodiment of the present invention, the cable 50 is connected at a position approximately ⅓ of the way toward the second end 22 of the crossbar 14, although those skilled in the art will appreciate that this position may be readily adjusted to suit crossbars of different weights and sizes without departing from the spirit of the present invention.

A centrally positioned pulley 56 controls the movement of the cable 50 as the crossbar 14 moves up and down. The pulley 56 is secured adjacent the upper end of the upwardly extending post 46 and is protected by a pair of pulley shields 58.

Movement of the crossbar 14 is further facilitated by the provisions of handles 60 along the underside 62 of the crossbar 14. The handles 60 allow a user to readily grip the crossbar 14 for controlled movement between open and closed positions. Protection of machinery, supplies and people coming into contact with the barrier gate 10 is enhanced by the provision of rubber bumpers 64 along the anchor post 18 and the saddle post 16.

In practice, the barrier gate 10 is positioned in front of an access opening one wishes to protect. The barrier gate 10 is generally bolted to the support surface for secure and stable positioning in front of the access opening being protected. With this in mind, both the saddle post 16 and the anchor post 18 are provided with perpendicular on rented base plates 66, 68 that may be bolted to the support surface for securing the anchor post and saddle post into position. Buttresses 70 are also provided for supporting the gate 10.

In accordance with a preferred embodiment of the present invention, the saddle post 16, anchor post 18 components (upwardly extending post 46 and crossbar receiving member 34) are 4" by 4" square steel with 0.250" thick walls, the crossbar 14 is constructed from 3" by 3" square steel tubing with 0.125" thick walls, the base plates 66, 68 and pulley shields 58 are 0.125" thick steel and the rubber bumpers 64 are 2" by 2" extruded D-shaped dock bumpers.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A barrier gate, comprising:

a crossbar selectively pivoting between a saddle post and anchor post;

the crossbar including a first end and a second end, the first end of the crossbar is pivotally secured to the anchor post such that the second end of the crossbar may be selectively lifted from the saddle post opening the barrier gate and providing access therethrough;

a locking mechanism at the first end of the crossbar permitting the selective locking of the crossbar in a substantially vertically orientation; and a counterweight interacting with the crossbar assisting in the lifting of the crossbar between a closed orientation and an open orientation, and a cable linking the counterweight to the crossbar.

2. The barrier gate according to claim 1, wherein the anchor post is substantially hollow and the counterweight is housed therein.

3. The barrier gate according to claim 2, wherein a pulley guides the cable between the crossbar and the counterweight.

4. The barrier gate according to claim 2, wherein the anchor post includes an upwardly extending post in which the counterweight is housed and the pulley is secured at the upper end of the upwardly extending post.

5. The barrier gate according to claim 1, wherein the locking mechanism includes a slot formed along the first end of the crossbar such that the crossbar may be moved relative to the anchor post for locking the crossbar in a substantially vertical orientation.

6. The barrier gate according to claim 5, wherein the slot extends along the longitudinal axis of the crossbar.

7. The barrier gate according to claim 5, wherein the crossbar is telescopically received within the anchor post when in its vertical orientation.

8. The barrier gate according to claim 7, wherein the anchor post is substantially hollow and the counterweight is housed therein.

9. The barrier gate according to claim 8, wherein a pulley guides the cable between the crossbar and the counterweight.

10. The barrier gate according to claim 8, wherein the anchor post includes an upwardly extending post in which the counterweight is housed and the pulley is secured at the upper end of the upwardly extending post.

11. The barrier gate according to claim 5, wherein the anchor post includes a hollow crossbar receiving member, the crossbar receiving member including a cut-out recess in which the first end of the crossbar sits and the crossbar is telescopically received within the crossbar receiving member when in its vertical orientation.

12. The barrier gate according to claim 11, wherein the cut-out recess includes upwardly extending walls preventing lateral movement of the crossbar.

13. The barrier gate according to claim 11, wherein when the crossbar is rotated upwardly to its vertical orientation, the first end of the crossbar slides downwardly into the crossbar receiving member and movement of the crossbar is limited by the length of the slot and its interaction with a pivot pin passing through the slot and pivotally coupling the first end of the crossbar to the anchor post.

14. The barrier gate according to claim 1, wherein the crossbar is provided with handles.

* * * * *